United States Patent [19]

Lee et al.

[11] Patent Number: 5,032,768

[45] Date of Patent: Jul. 16, 1991

[54] GAS DISCHARGE DISPLAY DEVICE

[75] Inventors: Seung-Woo Lee; Hong-Seo Yom, both of Seoul, Rep. of Korea

[73] Assignee: Samsung Electron Devices Co., Ltd., Kyonggi-do, Rep. of Korea

[21] Appl. No.: 403,346

[22] Filed: Sep. 6, 1989

[30] Foreign Application Priority Data

Dec. 26, 1988 [KR] Rep. of Korea ..... 88-21550

[51] Int. Cl.[5] ..... H01J 17/49

[52] U.S. Cl. ..... 313/582; 313/584; 313/609; 313/621; 313/632

[58] Field of Search ..... 313/581, 582, 584, 586, 313/609, 610, 621, 622, 631, 632

[56] References Cited

U.S. PATENT DOCUMENTS 3,755,027 8/1973 Gilsing ..... 313/584 X
3,849,688 11/1974 Maloney et al. ..... 313/585
4,338,539 7/1982 Littwin ..... 313/584 X

*Primary Examiner*—Donald J. Yusko
*Assistant Examiner*—Michael Horabik
*Attorney, Agent, or Firm*—Flynn, Thiel, Boutell & Tanis

[57] ABSTRACT

A gas discharge device having the characteristic of low discharge voltage, the construction being such that the cathode is surrounding the discharge space of the anode. A barrier and the cathode are each alternately formed with different height portions; also, said cathode forms a half-circle groove surrounding the discharge space of said anode; said barrier forms a similar groove sidewardly adjoining the cathode groove; and wholly, said discharge space is oriented transversely relative to the anode.

3 Claims, 2 Drawing Sheets

GAS DISCHARGE DISPLAY DEVICE

BACKGROUND OF THE INVENTION

1. Field of the Invention

The present invention relates generally to a gas discharge display device, and more specifically a gas discharge display device operable with a low discharge voltage and having the construction that the cathode surrounding relationship with the discharge space of the anode.

2. Description of the prior Arts

In a known gas discharge device as shown in FIG. 1, a plurality of barriers 3 are spaced apart between the upper plate glass 1 and the lower plate glass 2, the discharge space 6 is defined between the anode 4 and the cathode 5 respectively arranged in a pattern to extend orthogonally of each other on the internal surfaces of said upper and lower plate glasses 1, 2. The discharge space 6 has a construction for sealing an inert gas, and if voltage is applied to said anode 4 and said cathode 5, an electron emits from the cathode 5 and collides with the inert gas in the discharge space 6 to thereby light the character to be displayed.

When discharging such as above, due to the phenomenon of sputtering in the cathode 5, damage to and loss of the cathode occurs. As a conventional cathode 5 has a strip shape, the electron emission of the cathode is not done well during the sputtering phenomenon, and consequently it is a problem that the life of the cathode is shortened.

To solve problems as above, it is well known that mercury is used but does harm to a person. Since the dangerousness of process and usage is latent, the method as above is undesirous.

Alternatively, in U.S. Pat. No. 3,849,688 the first electrode and the second electrode are arranged at different vertical heights, and the second electrode has triangular ribs thereon.

Particularly, the conventional cathode construction is such that the light is generated in discharging when atoms of a metastable state are moved by diffusion, and because the probability to move them in the cathode is very small and the expectation of electron emission is very small, it is a defect that the high discharge voltage is required.

Alternatively, when the conventional barrier construction is formed in the print method, the alignment and the print process are very difficult because the cathode is processed independently.

SUMMARY OF THE INVENTION

It is an object of the present invention to extend the cathode life and lessen the cathode loss showing in the prior arts, to improve the discharge of the cathode during the sputtering phenomenon, and to depress the discharge voltage by readily performing the discharge and associated lighting utilizing the atoms of metastable state.

To accomplish the above object, the invention comprises: a barrier and a cathode each having portions of alternatingly different height; said cathode includes spaced grooves which each define a half-circle surrounding the discharge space of an anode; said barrier includes spaced grooves similar to said cathode grooves respectively adjoining them in a sideward direction; and as a whole, said discharge space 16 is defined transversely relative to the anode.

BRIEF DESCRIPTION OF THE DRAWINGS

In order for the present invention to be better understood and readily practiced, a preferred embodiment will be described, by way of example only, in conjunction with the accompanying drawings wherein.

DESCRIPTION OF THE PREFERRED EMBODIMENTS

Figure 1:
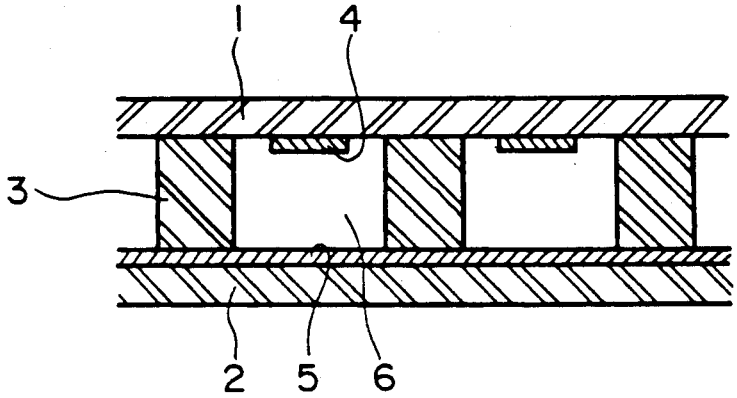
FIG. 1 PRIOR ART
FIG. 1 is a sectional view of a conventional gas discharge display device.
Figure 2:
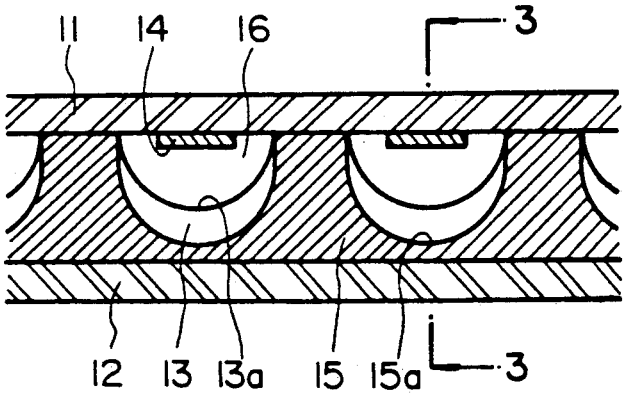
FIG. 2 is a sectional view of a gas discharge display device according to the present invention.
Figure 3:
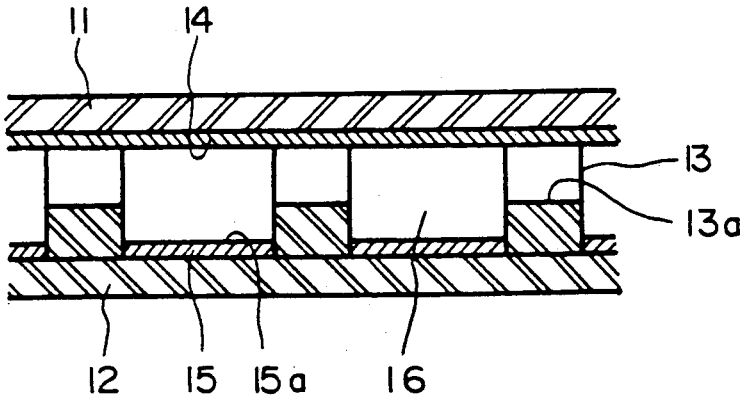
FIG. 3 is a sectional view in the direction of arrows 3—3 in FIG. 2

The gas discharge display device of FIGS. 2 and 3 includes a plurality of barriers 13 which retain a gap between the upper glass 11 and the lower glass 12, a cathode pattern 15 orthogonal to an anode pattern 14 an the internal surface of the upper glass 11 said cathode 15 forms a half-circle groove 15*a* surrounding a discharge space 16 of said anode 14, and the barrier 13 has a groove 13*a* of similar form which sidewardly adjoins the groove 15*a* of said cathode 15. As a whole, said discharge space 16 is defined transversely relative to the anode, while the internal groove of said barrier 13 is higher than the internal groove of said cathode 15. Accordingly, the height of the groove 15*a* of said cathode is different from the height of the groove 13*a* of the barrier.

Referring to the construction of the present invention such as above, as the level of the barrier groove 13*a* above the lower glass 12 is unsimilar to the level of the cathode groove 15*a*, and because the grooves are also sequentially sidewardly aligned with each other, the alignment is easy and the print process can be readily performed at the same time.

The cathode 15 emitting the electron forms a half-circle groove 15*a* surrounding the discharge space 16 around the anode, and the internal groove 15*a* of a half-circle provides a wide surface for emitting the electrons, as described above. The cathode material sputtered by the sputtering phenomenon of the cathode 15 is inclined to be retrieved into the internal groove 15*a* of the cathode 15 surrounding said discharge space 16, thus making the loss of the cathode very low.

Accordingly, to lessen the loss of the cathode, mercury is not needed as in the conventional method, and the stability is improved.

Alternatively, since the discharge space 16 is defined transversely relative to the anode 14 by means of the form of the groove 13*a* of the barrier 13 identical to the form of the groove 15*a* of said cathode 15, the light generated by discharge and the diffusion of the atoms of the metastable state are helpful to the cathode material sputtered, particularly since said discharge space 16 is surrounded by the cathode 15. The light and the electron emission factor of the cathode 15 produced by the atoms of the metastable state are high and thus the discharge efficiency is high, making it possible to keep the discharge voltage low.

Accordingly, the height of the internal groove 13*a* of said barrier 13 is higher than the height of the internal groove 15*a* of said cathode 15, such that the light generated from one discharge space 16 between the barriers 13 does not interfere with the other discharge spaces.

Figure 4:
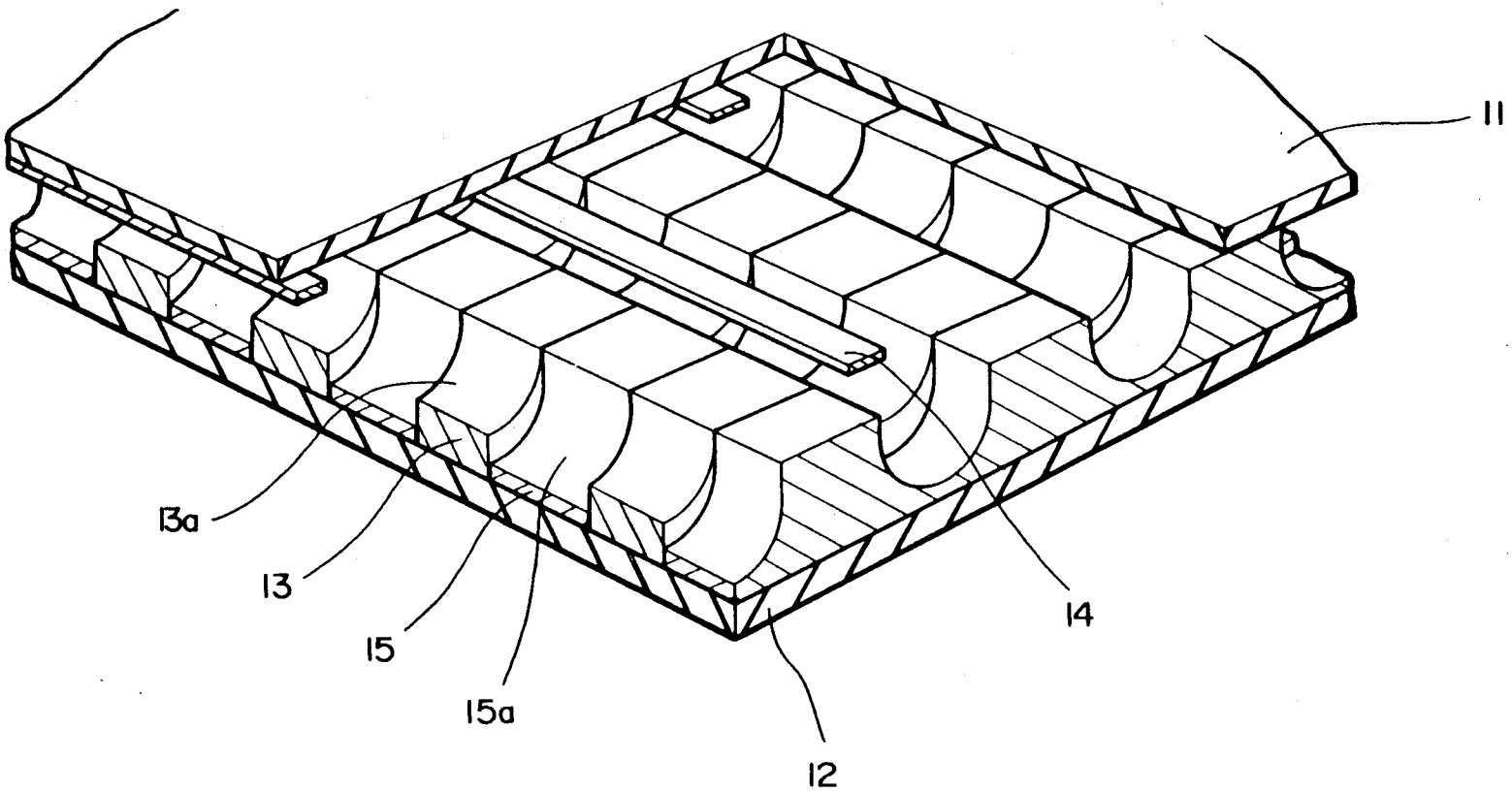
FIG. 4 is a perspective view of a gas discharge display device according to the present invention.

FIG. 4 is a perspective view of the gas discharge display device of the invention, the cathode 15 on the lower glass 12 having a half-circle groove 15*a*, and the continuous barrier 13 having a half-circle groove 13*a*.

Accordingly, said cathode groove 15*a* and the barrier groove 13*a* are formed in respective adjacent layers.

As described above, the present invention has the following advantages:

firstly, because the cathode material associated with the sputtering phenomenon of the cathode is retrieved into the cathode and the cathode loss is low, cathode life extension results;

secondly, since the atom spectrum of the cathode material improves the discharge by increasing the cathode material, the discharge voltage can be efficiently depressed; and thirdly, the alignment of the barrier and the cathode and the effect of the print process are easy.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. In a gas discharge display device including a pair of plates supported in generally parallel and opposed relationship and having mutually facing surfaces, a plurality of elongated anodes disposed in mutually spaced and parallel relationship on one of said plate surfaces, a plurality of elongated cathodes disposed in mutually spaced and parallel relationship on the other of said plate surfaces, said cathodes extending generally perpendicular relative to said anodes, a plurality of barriers interposed between said plate surfaces and defining a gap therebetween, and means for sealingly confining a gas in said gap between said plates, the improvement wherein:

said barriers are elongated and extend generally parallel to said cathodes, said cathodes and said barriers including a plurality of first portions having a first height and a plurality of second portions having a second height, said first and second portions being arranged alternatingly in the elongate direction, said second portions of said barriers and said cathodes defining generally rounded grooves therein between said first portions thereof, said barriers being interposed between respective adjacent pairs of said cathodes, said first portions of said barriers and said cathodes being generally sidewardly aligned, said rounded grooves of said barriers and said cathodes also being generally sidewardly aligned in sidewardly adjoining relationship, said sidewardly aligned first portions of said cathodes and said barriers being positioned between respective adjacent pairs of said anodes, and said grooves of said cathodes being registered with and opening toward respective said anodes to define discharge spaces around said anodes in said gap.

2. A device according to claim 1, wherein said plates are glass, and said barriers and said cathodes contact both of said plate surfaces.

3. A device according to claim 2, wherein said rounded grooves of said cathodes are deeper than said rounded grooves of said barriers such that said anodes are spaced further across said gap from said cathodes than said barriers.

* * * * *